US005881691A

United States Patent [19]

Schmidt et al.

[11] Patent Number: 5,881,691

[45] Date of Patent: Mar. 16, 1999

[54] FINGER LEVER OR ROCKER ARM FOR A VALVE DRIVE OF AN INTERNAL COMBUSTION ENGINE

[75] Inventors: Dieter Schmidt, Nürnberg; Thomas Römmer, Friesen, both of Germany

[73] Assignee: INA Walzlager Schaeffler OHG, Germany

[21] Appl. No.: 22,941

[22] Filed: Feb. 12, 1998

[30] Foreign Application Priority Data

Feb. 19, 1997 [DE] Germany ..... 197 06 441.8

[51] Int. Cl.[6] ..... F01L 1/18; F01L 1/24

[52] U.S. Cl. ..... 123/90.46

[58] Field of Search ..... 123/90.39, 90.45, 123/90.46, 90.55

[56] References Cited

U.S. PATENT DOCUMENTS

| | | | |
|---|---|---|---|
| 5,172,663 | 12/1992 | Fujiwara | 123/90.46 |
| 5,609,133 | 3/1997 | Hakansson | 123/90.46 |
| 5,632,237 | 5/1997 | Cornell et al. | 123/90.46 |
| 5,709,181 | 1/1998 | Williams | 123/90.46 |

FOREIGN PATENT DOCUMENTS

| | | | |
|---|---|---|---|
| 31 18 466 A1 | 11/1982 | Germany . | |
| 60-88809 | 5/1985 | Japan | 123/90.46 |
| 2 162 608 A | 2/1986 | United Kingdom . | |
| WO 96/18806 | 6/1996 | WIPO . | |

*Primary Examiner*—Weilun Lo

*Attorney, Agent, or Firm*—Panitch Schwarze Jacobs & Nadel, P.C.

[57] ABSTRACT

A rocker arm (1) or finger lever for a valve drive of an internal combustion engine is provided in which a guide bushing (7) is press-fit in a receptacle hole (2). The guide bushing (7) has a bore (9) in which an outer part (4) of a hydraulic play compensation component (3) is guided in a sliding manner. The guide bushing (7) has a radially inwardly directed projection (10) which holds a shoulder formed by a diameter reduction of the outer part (4) from behind or meshes in a groove of the outer part (4). This arrangement allows the hydraulic play compensation component (3) to be secured from loss using the press-fit guide bushing (7).

3 Claims, 3 Drawing Sheets

FINGER LEVER OR ROCKER ARM FOR A VALVE DRIVE OF AN INTERNAL COMBUSTION ENGINE

BACKGROUND OF THE INVENTION

The invention involves a finger lever or rocker arm for a valve drive of an internal combustion engine having a hydraulic play compensation component, which is guided by an outer part to slide in a bore of a guide bushing which is press-fit in a receptacle hole of the finger lever or rocker arm and is supported axially on the bottom by an inner part.

A rocker arm of this type is known from German patent DE 31 18 466 A1. In the receptacle hole of the rocker arm, a guide bushing is press-fit and has a bore in which the outer part of a hydraulic play compensation component is guided in a sliding manner. In this way, it is possible to save on costly measures in processing of the receptacle hole in the rocker arm, and instead manufacturing the receptacle hole as a simple drill hole for which only certain requirements must be made with regard to roundness and the accuracy of diameter, which however, are easily met with modern processing machines. The receptacle hole to be provided in the rocker arm does not need to have either a special surface quality or a surface hardness. On the contrary, these qualities are provided by the press-fit guide bushing.

On its end which faces away from the gas exchange valve, the guide bushing is closed by a base, in which a ventilating valve is located. Furthermore, the guide bushing has, on its lower end, a flange directed outwardly by which it is supported on the face of the rocker arm. The hydraulic play compensation component is received in a central bore and a retaining element is attached to the flange which prevents the hydraulic play compensation element from falling out of the rocker arm.

In this way, however, it is disadvantageous, on the one hand, that this retaining element is manufactured and must be mounted as a supplemental structural component, and on the other hand, that an increased structural space requirement results due to the flange of the guide bushing being directed radially outwardly.

BRIEF SUMMARY OF THE INVENTION

The purpose of the invention is to reduce the production expense during the manufacturing of a rocker arm or finger lever having a press-fit guide bushing.

This purpose is achieved according to the invention in that the guide bushing has, on its side which faces away from the base, a radially inwardly directed projection which holds a shoulder formed by a diameter reduction of the outer part from behind, or meshes in a groove of the outer part. By this measure according to the invention, the supplemental retaining element required until now becomes unnecessary and no additional structural space is required since the press-fit guide bushing need not project out of the receptacle hole of the rocker arm or finger lever in order to support itself on the face.

Further advantageous embodiments of the invention are described below.

Preferably, the projection may be constructed as a surrounding flange or as uniformly spaced apart retainer projections.

Additionally, the guide bushing may be constructed as a deep-drawn piece formed without machining. Namely, it can be manufactured in a single manufacturing operation in a cost-effective manner without requiring subsequent processing, for example by grinding.

The invention is explained more fully below with respect to the preferred embodiment.

BRIEF DESCRIPTION OF THE SEVERAL VIEWS OF THE DRAWINGS

The foregoing summary, as well as the following detailed description of the preferred embodiment of the invention, will be better understood when read in conjunction with the appended drawing. For the purpose of illustrating the invention, there is shown in the drawing an embodiments which is presently preferred. It should be understood, however, that the invention is not limited to the precise arrangements and instrumentalities shown.

DETAILED DESCRIPTION OF THE INVENTION

Figure 1:
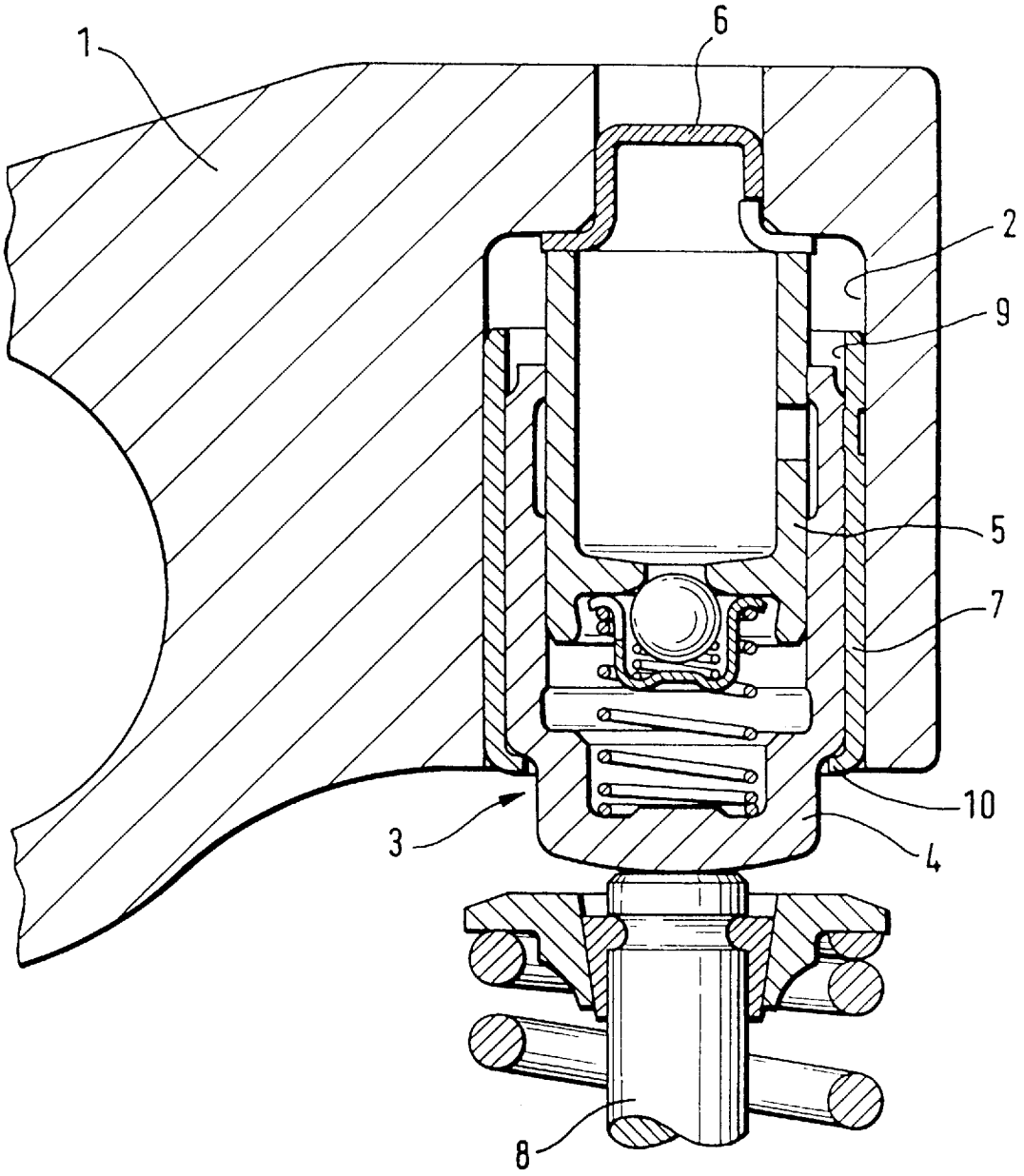
FIG. 1 is a lengthwise section through a part of a rocker arm having a hydraulic plate compensation component shown in a mounted position.

The rocker arm 1 shown in FIG. 1 has a receptacle hole 2 for receiving a hydraulic play compensation component 3, which includes an outer part 4 and an inner part 5. The inner part 5 is supported on the bottom of the receptacle hole 2 on a support disc 6, while the outer part 4 is easily moved and guided in a bore 9 of a guide bushing 7, and is in active connection on its lower end with a valve shaft 8 of a gas exchange valve of an internal combustion engine.

Figure 2:
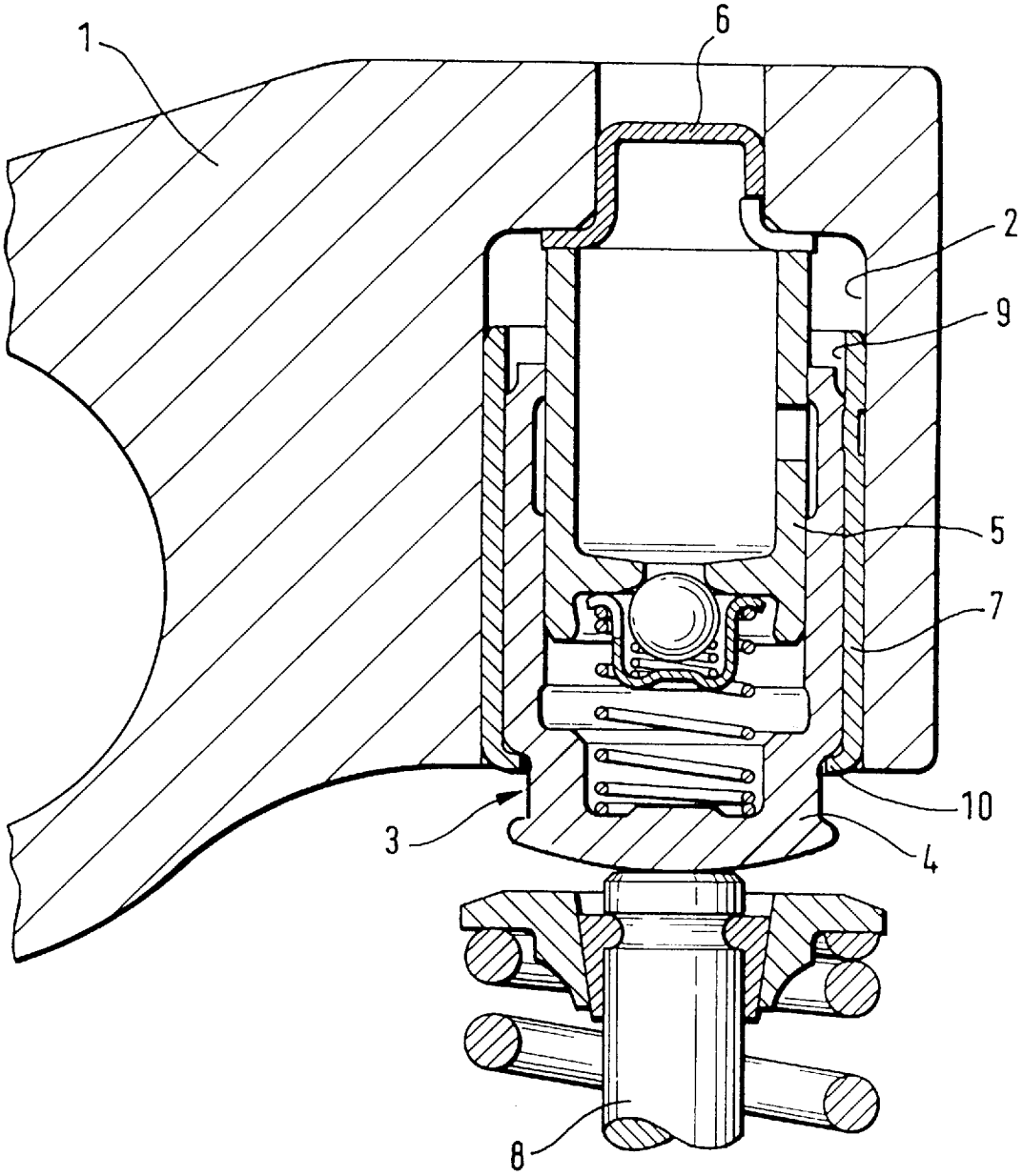
FIG. 2 is a lengthwise section similar to FIG. 1 showing an alternate embodiment of the hydraulic play compensation component in the mounted position.

The guide bushing 7 is constructed as an open hollow cylinder on both ends and has, on its side facing away from the bottom of the receptacle hole 2, a radially inwardly directed projection 10 which holds a shoulder formed by a diameter reduction of the outer part 4 from behind so that the hydraulic play compensation component 3 is held securely against loss in the receptacle hole 2 of the rocker arm 1, namely in the bore 9 of the guide bushing 7. Alternatively, the projection 10 could mesh in a groove on the outer part 4, as shown in FIG. 2.

Figure 3:
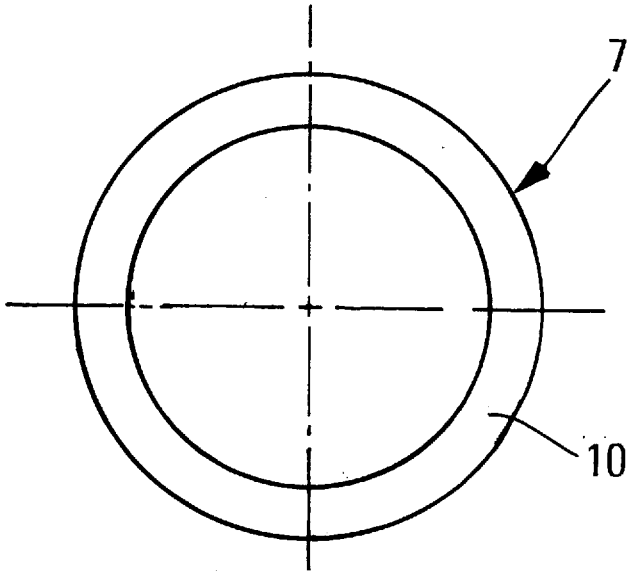
FIG. 3 is a plan view of the guide bushing used in a preferred embodiment of the invention.
Figure 4:
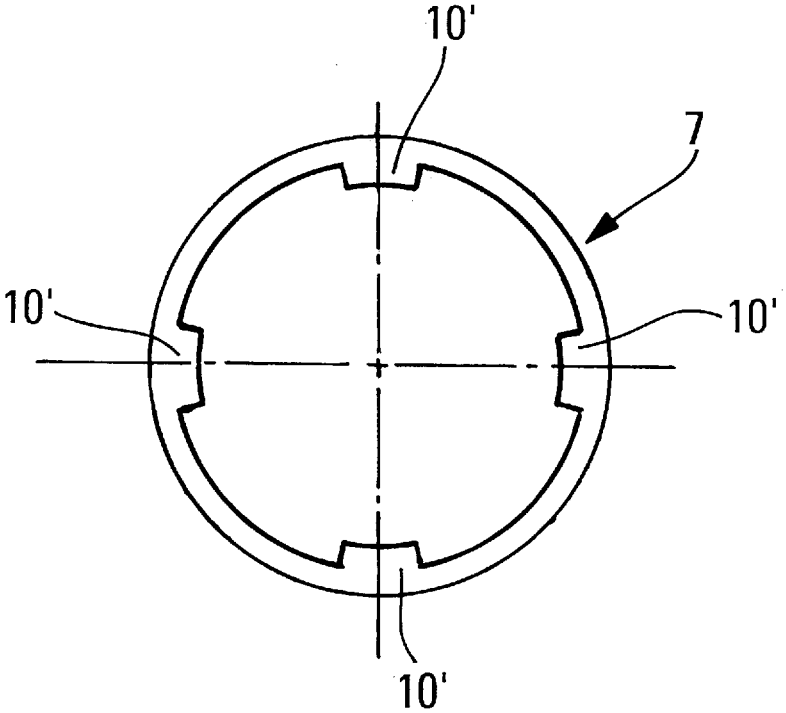
FIG. 4 is an alternate embodiment of the guide bushing in which the radially inwardly directed projection is formed as uniformly spaced apart retainer projections.

As shown in FIG. 3, the projection 10 may be constructed as a surrounding flange formed as one piece with the guide bushing 7. Alternatively, as shown in FIG. 4, the projection may comprise uniformly spaced apart retainer projections 10'.

In contrast to the existing state of the art, the guide bushing 7, which is press-fit in the rocker arm 1, provides along with the already known reduction of the production expense in manufacturing the receptacle drill hole 2, an additional holding function for holding the hydraulic play compensation component 3 secure against loss. In this manner, on the one hand, additional holding components are not required and, on the other hand, structural space is gained in the radial direction around the part of the hydraulic play compensation component 3 projecting out of the receptacle hole 2 or the bore 9.

It will be appreciated by those skilled in the art that changes could be made to the embodiment described above without departing from the broad inventive concept thereof. It is understood, therefore, that this invention is not limited to the particular embodiment disclosed, but it is intended to cover modifications within the spirit and scope of the present invention as defined by the appended claims.

What is claimed is:

1. One of a rocker arm (1) and a finger lever for a valve drive of an internal combustion engine comprising a hydraulic play compensation component (3), which is guided using an outer part (4) that slides in a bore (9) of a guide bushing (7) which is press-fit in a receptacle hole (2) of the rocker arm (1) and is supported axially on a bottom of the receptacle hole by an inner part (5), the guide bushing (7) having on a side facing away from the bottom, a radially inwardly directed projection (10) formed as one piece with the guide bushing which a shoulder formed by a diameter reduction of the outer part (4) from behind, or meshes in a groove of the outer part (4).

2. The one of the rocker arm and finger lever according to claim 1, wherein the projection (10) is constructed as one of a surrounding flange and uniformly spaced apart retainer projections.

3. The one of the rocker arm (1) and finger lever according to claim 1, wherein the guide bushing (7) is constructed as a deep-drawn piece formed without machining.

* * * * *